United States Patent [19]

Cohen

[11] Patent Number: 4,675,956

[45] Date of Patent: Jun. 30, 1987

[54] SAFETY SEAT BELT BUCKLE

[76] Inventor: Randy Cohen, 698 Mansell Dr., Youngstown, Ohio 44505

[21] Appl. No.: 843,244

[22] Filed: Mar. 24, 1986

[51] Int. Cl.[4] ..... A44B 11/25

[52] U.S. Cl. ..... 24/657; 24/642; 24/635; 24/639

[58] Field of Search ..... 24/657, 583, 585, 634, 24/639, 635, 637, 642, 643, 648, 655, 664, 677

[56] References Cited

U.S. PATENT DOCUMENTS

| | | | |
|---|---|---|---|
| 487,389 | 12/1892 | Franke | 24/635 X |
| 1,520,038 | 12/1924 | Tueckmantel | 24/657 X |
| 2,016,827 | 10/1935 | Bergstrom | 24/642 X |
| 2,941,272 | 6/1960 | Bourguignon | 24/657 |
| 3,201,840 | 8/1965 | Jantzen | 24/634 |
| 3,704,492 | 12/1972 | Meredith Sr. | 24/639 X |
| 3,728,764 | 4/1973 | Carter | 24/642 |
| 3,986,234 | 10/1976 | Frost et al. | 24/635 |
| 4,245,376 | 1/1981 | Lassche | 24/639 |

FOREIGN PATENT DOCUMENTS

| | | | |
|---|---|---|---|
| 580385 | 7/1959 | Canada | 24/642 |
| 2813027 | 10/1978 | Fed. Rep. of Germany | 24/642 |
| 2062088 | 5/1981 | United Kingdom | 24/642 |
| 2070677 | 9/1981 | United Kingdom | 24/642 |

*Primary Examiner*—Peter A. Aschenbrenner
*Assistant Examiner*—Laurie K. Cranmer
*Attorney, Agent, or Firm*—Harpman & Harpman

[57] ABSTRACT

A safety seat belt buckle that restricts and limits accidental and intentional buckle release by children. The seat belt buckle has two interdependent release actuators that must be simultaneously depressed to release the seat belt buckle.

5 Claims, 5 Drawing Figures

SAFETY SEAL BELT BUCKLE

BACKGROUND OF THE INVENTION

1. Technical Field

This invention relates to limited access safety seat belt buckles used in automobile safety seat belts.

2. Description of the Prior Art

Prior art devices of this type have relied on a variety of different designs to restrict and limit the unbuckling of seat belts. See for example U.S. Pat. Nos. 3,201,840 and 3,704,492.

In U.S. Pat. No. 3,201,840, a safety seat belt device is disclosed that utilizes a pair of oppositely disposed pivoted arms that are spring urged against a release bolt within the buckle.

U.S. Pat. No. 3,704,492 shows a safety seat belt buckle that uses a pair of oppositely disposed buttons that activate a pair of pins that engage the belt. Movement of the slidable elements releases the belt buckle mechanism.

SUMMARY OF THE INVENTION

A safety seat belt buckle device that requires the operator to depress two oppositely disposed levers to effect a release of the buckle. The buckle has a release configuration that frees an internal latch by elevating a portion of the same from engagement with a seat belt portion inserted into the safety seat belt buckle assembly.

DESCRIPTION OF THE PREFERRED EMBODIMENT

Figure 1:
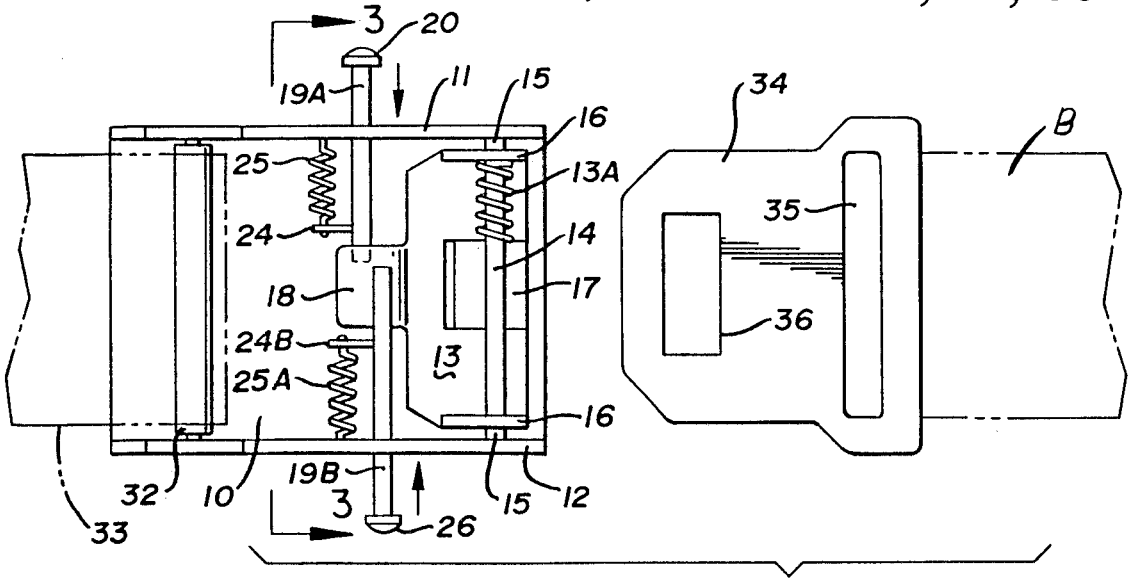
FIG. 1 is a top plan view of a seat belt and buckle assembly with a portion cut away.
Figure 2:
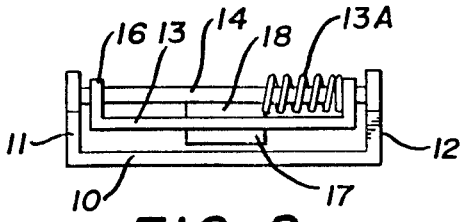
FIG. 2 is an end view of the safety buckle.
Figure 3:
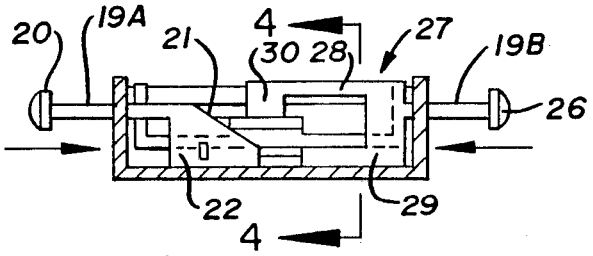
FIG. 3 is a view on lines 3—3 of FIG. 1.

A safety seat belt buckle device for use in automobile seat belts comprises a rectangular base 10 having upstanding oppositely disposed side walls 11 and 12. A latch 13 is pivotally positioned within the base 10 adjacent one end by a support rod 14 movably secured transversely between the upstanding side walls 11 and 12 at 15. The latch 13 has a pair of oppositely disposed apertured mounting tabs 16 through which the support rod 14 extends. The latch 13 has a centrally located depressed flange 17 and a release tab 18 which extends upwardly and outwardly therefrom. A pair of oppositely disposed offset lever actuators 19A and 19B extend through respective side walls 11 and 12 as best seen in FIGS. 1 and 3 of the drawings. The lever actuator 19A has an enlarged button 20 on one end and an inclined plane configuration 21 on the other end. The inclined plane 21 has a base 22 that slidably engages the rectangular base 10 in a guide slot 23 formed therein.

A spring mount 24 extends from one side of said lever actuator 19A with a spring 25 positioned from the side wall 11 to the spring mount 24 to impart resilient resistance to said lever actuator 19A. It should be noted that the inclined plane 21 of the actuator lever 19A partially extends passed a point of engagement with the release tab 18 as indicated in broken lines in FIG. 1 of the drawings.

The lever actuator 19B has an enlarged button 26 on one end with a notched configuration 27 on the other end inside the base 10. The notched configuration 27 comprises vertically spaced upper and lower armatures 28 and 29 with the upper armature 28 having a downturned portion 30 engageable on the upper surface of said release tab and the lower armature 29 slidably engaging said base 10 in a guide track 31. A spring mount 24B extends from one side of the lever activator 19B with a spring 25A positioned from the side wall 12 to the spring mount 24B. A belt adjustment lock rod 32 is positioned transversely adjacent the other end of said base 10 aligned in angled slots in said side walls 11 and 12 respectively.

A seat belt 33 shown in broken lines in FIG. 1 of the drawings extends around said lock rod 32 as will be well known and understood by those skilled in the art.

Figure 4:
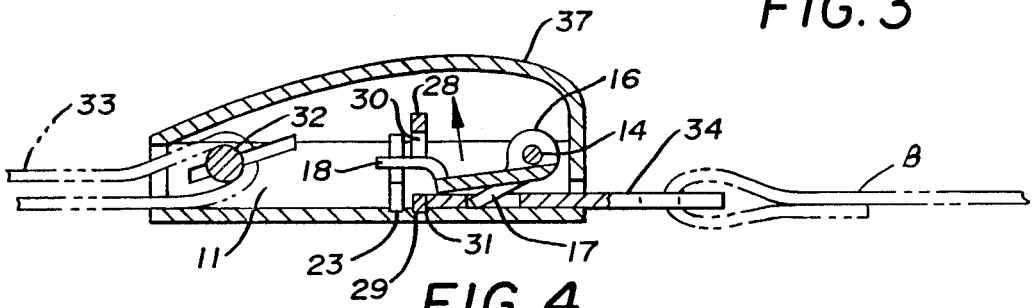
FIG. 4 is a cross sectional view of the safety seat belt buckle in latch configuration with a belt portion.
Figure 5:
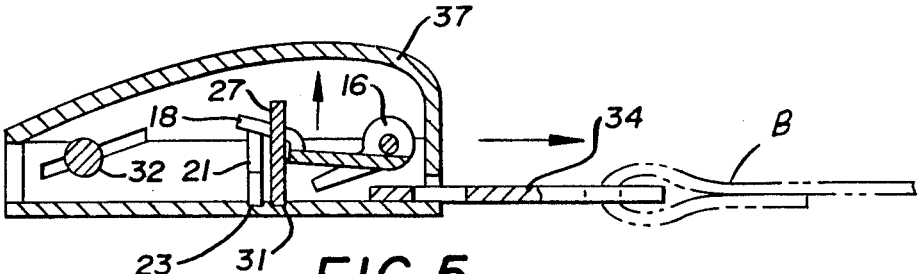
FIG. 5 is a cross sectional view of the safety seat belt buckle in unlatched position.

A belt end tongue 34 is of a well known configuration having a belt engagement slot 35 and a latch engagement opening 36 as best seen in FIGS. 1, 4 and 5 of the drawings.

In operation, the belt tongue 34 is inserted into the safety seat belt buckle forcing the latch 13 upwardly against a spring 13A on the support rod 14 until registration of the depressed flange 17 within the latch engagement opening 36 as seen in locked position in FIG. 4 of the drawings. To unlock the safety seat belt buckle, the user must depress both the lever actuators 19A and 19B moving respectively the inclined plane 21 against the release tab 18 and the notched configuration 27 inwardly over the release tab 18 so that the downturned portion 30 moves passed the release tab 18 allowing the same to be moved upwardly by the inclined plane 21 as seen in FIG. 5 of the drawings. As the tab 18 moves, the recessed flange 17 clears engagement with the registering slot 36 in the belt end tongue 34 freeing the same and its associated belt B to be removed from the buckle as indicated by the arrow in FIG. 5 of the drawings.

A buckle cover 37 is secured over and onto the base 10 enclosing the base and the above described mechanism.

It will be evident from the above description that the safety seat belt buckle device will prevent the accidental or deliberate release of the safety seat belt buckle by children who will not be able to depress both of the actuation levers simultaneously with the required force as determined by the springs 25A and 25. Movement of either actuation lever 19A and 19B will not release the belt tongue 34 and attached belt B.

It will thus be apparent to those skilled in the art that the new and novel safety seat belt buckle can be adapted to be used on existing seat belts now found in the industry. An adapter tongue an belt (the same as seen in FIG. 1 of the drawings at 34 with a shortened belt portion) could be used wherein the belt tongue is inserted into the existing seat belt buckle (not shown) with the safety seat belt buckle of this invention secured to the belt on the opposite end as seen in FIG. 1 of the drawings. A featureless cover (not shown) would encase the existing release buckle mechanism eliminating access thereto.

It will thus be seen that a new and useful safety seat belt buckle has been illustrated and described and that various changes and modifications may be made therein without departing from the spirit of the invention and having thus described my invention, what I claim is:

1. A safety seat belt buckle comprises an enclosure having a pair of oppositely disposed elongated openings therein, a latch pivotally secured within said enclosure, said latch having a release tab and a depressed flange extending therefrom, a pair of oppositely disposed independent actuator levers within said enclosure registerable with said release tab, one of said actuator levers having an incline plane on one end thereof, the other of said actuator levers having a notched area inwardly of its end, means for adjustably securing a seat belt to said seat belt buckle and guide means for resiliently positioning said actuator levers within said enclosure.

2. The safety seat belt buckle of claim 1 wherein said depressed flange is engageable with a seat belt tongue removably positioned in said enclosure.

3. The safety seat belt buckle of claim 1 wherein said guide means for resiliently positioning the actuator levers within the enclosure comprises a spring on said levers and guide channels in said enclosure.

4. The safety seat belt buckle of claim 1 wherein said release tab is vertically offset in relation to said latch and to said depressed flange.

5. The safety seat belt buckle of claim 1 wherein said pivotally positioned latch is spring urged within the enclosure and said release tab is positioned vertically between said incline plane and said notched area of said oppositely disposed independent actuator levers.

* * * * *